US006722858B2

(12) United States Patent
Yoshimura et al.

(10) Patent No.: US 6,722,858 B2
(45) Date of Patent: Apr. 20, 2004

(54) OIL-COOLED TYPE COMPRESSOR

(75) Inventors: Shoji Yoshimura, Takasago (JP); Takao Ohama, Takasago (JP)

(73) Assignee: Kobe Steel, Ltd., Kobe (JP)

( * ) Notice: Subject to any disclaimer, the term of this patent is extended or adjusted under 35 U.S.C. 154(b) by 72 days.

(21) Appl. No.: 10/103,995

(22) Filed: Mar. 25, 2002

(65) Prior Publication Data

US 2002/0164254 A1 Nov. 7, 2002

(30) Foreign Application Priority Data

Mar. 26, 2001 (JP) ..... 2001-087483
May 22, 2001 (JP) ..... 2001-152542
Aug. 3, 2001 (JP) ..... 2001-236314

(51) Int. Cl.[7] ..... F25B 43/02

(52) U.S. Cl. ..... 417/313; 62/470; 184/6.4; 184/7.4; 418/DIG. 1

(58) Field of Search ..... 62/84, 129, 193, 62/470; 184/6.4, 7.4; 417/63, 313; 418/2, DIG. 1

(56) References Cited

U.S. PATENT DOCUMENTS 3,191,854 A * 6/1965 Lowler et al. ..... 418/DIG. 1
4,080,593 A * 3/1978 Gernandt et al. ..... 340/605
4,677,374 A * 6/1987 Kato et al. ..... 73/116
4,686,453 A * 8/1987 Kato et al. ..... 73/116
4,872,316 A * 10/1989 Browne et al. ..... 62/470
5,624,236 A * 4/1997 Kubo et al. ..... 417/32
5,884,494 A * 3/1999 Okoren et al. ..... 62/129
5,948,968 A * 9/1999 Ehlert ..... 184/6.4

* cited by examiner

*Primary Examiner*—Michael Koczo
(74) *Attorney, Agent, or Firm*—Oblon, Spivak, McClelland, Maier & Neustadt, P.C.

(57) ABSTRACT

The oil-cooled type compressor 1A houses therein an inspecting flow passage 19 branched from a discharge flow passage 12 on the secondary side of an oil separation recovering portion 14 and joined with a suction flow passage 11 which is a lower pressure portion than the branched point, and an oil separating element 22 capable of capturing finer oil particles as compared with an oil separating element 15 within the oil separating recovering portion 14, and houses therein an oil droplet detection means 23 for outputting a signal electrically showing a state change upon receipt of oil droplets dropped from the oil separating element 22, being provided with an oil separation detector 21 interposed in the inspecting flow passage 19, and a calculating portion 24 for receiving an electric signal from the oil droplet detection means 23 to calculate the percentage content of oil of the compressed gas from the interval of the electric signal to output it.

18 Claims, 12 Drawing Sheets

OIL-COOLED TYPE COMPRESSOR

BACKGROUND OF THE INVENTION

The present invention relates to an oil-cooled type compressor having a mechanism for detecting the percentage content of oil in discharge gases after separation of oil.

As equipment for compressing gas to blow it, the oil-cooled type compressors have been widely known. In the oil-cooled type compressor, since the compressed gas is discharged with oil accompanied, it is necessary to deliver the compressed gas in a clean state with oil removed to the supply destination for compressed gas, and an oil separation recovering portion is provided in the discharge flow passage. In the oil separation recovering portion, first, relatively large-diameter oil particles flown in together with the compressed gas are separated and recovered making use of the collision action and the gravity sinking action in the course that they are collided and reflected on the internal wall surfaces or the like to reduce the percentage content of oil in the compressed gas to 1000 ppm (wt). Further, internally of the oil separation recovering portion is provided an oil separating element using non-woven fabric, for example, such as cellulose fibers, and the compressed gas is delivered passing through the oil separating element. The fine oil particles are captured in the course that the compressed gas passes through the oil separating element, and are separated from the compressed gas. Normally, the percentage content of oil is lowered to 0.5 ppm (wt), and the compressed gas is delivered from the oil separation recovering portion.

The upper limit of the percentage content of oil after separation of oil is decided by the supply destination of the compressed gas, for example, apparatus such as a gas turbine using the compressed gas. In case of the gas turbine, when the percentage content of oil increases, carbide of oil is adhered to a fuel burner nozzle, resulting in poor combustion. To prevent this, it is necessary to always monitor the percentage content of oil. So, in the current circumstances, part of the compressed gas is taken out, which is caused to pass through filter paper only for a fixed time to thereby monitor the percentage content of oil. Further, more specifically, the filter paper through which the compressed gas passed for a fixed time is cleaned by a solvent, oil is dissolved into the solvent after which the solvent is vaporized, and the weight of the residual oil quantity is measured by a chemical balance to calculate the percentage content of oil.

In case of the above-described liquid-quantity measuring method, for obtaining the percentage content of liquid (in the above-described example, the percentage content of oil), a sheet of filter paper is used to measure the residual oil quantity one by one time. In this case, it is necessary to replace filter paper with new one every measurement, which operation need be repeated, thus taking time and failing to continuously carry out the monitoring.

SUMMARY OF THE INVENTION

The present invention has been accomplished in order to overcome such a problem as noted above with respect to prior art. There is provided an oil-cooled type compressor having a mechanism capable of always monitoring the percentage content of oil of gases.

For solving the above-described problem, according to the present invention, there is provided an oil-cooled compressor, comprising: a compressor body; a discharge flow passage for leading a compressed gas compressed by said compressor body to outside of said oil-cooled type compressor; a first oil separation means for separating oil discharged accompanied by said compressed gas from said compressed gas; an oil separation recovering portion housing said first oil separation means to recover the separated oil; an oil flow passage for leading the oil recovered by said oil separation recovering portion to an oiling portion within said compressor body through an oil cooler; an inspecting flow passage branched from said discharge flow passage on the downstream side of said oil separation recovering portion and in communication with a portion lower in pressure than said branched point; a second oil separation means capable of separating oil particles from the compressed gas flowing through said inspecting flow passage; and an oil separation detector for detecting that oil separated by said second oil separation means drops from said second oil separation means, said oil separation detector comprising an oil detection means for electrically detecting a state change caused by contact with the oil dropped from said second oil separation means, and a calculating portion for receiving an electric signal from said oil detection means to calculate the percentage content of oil of said compressed gas from said electric signal.

By the constitution as described above, in the oil-cooled type compressor, the percentage content of oil in the compressed gas can be monitored easily and constantly.

In the above-described oil-cooled type compressor, there can be constituted so that said inspecting flow passage is in communication with a suction flow passage which is a flow passage of gas flowing into said compressor body. Or, there can be constituted so that said inspecting flow passage is joined with a discharge flow passage on the downstream side away from said branched point, and a throttle means is interposed between said branched point and said joined point.

In the above-described oil-cooled type compressor, preferably, there is constituted so that said second oil separation means is able to capture fine oil particles than said first oil separation means.

In the above-described oil-cooled type compressor, preferably, said second oil separation means has the shape of a lower part thereof constituted so that the separated oil drops on a fixed position.

In the above-described oil-cooled type compressor, preferably, said second oil separation means has the shape of a lower end thereof constituted to be spherical. Further preferably, there is constituted so that said spherical portion has a slit. By the constitution as described, one droplet of oil quantity is stabilized, and the percentage content of oil can be calculated more accurately.

In the above-described oil-cooled type compressor, said second oil separation means may be constituted so that oil drops on a plurality of positions. By the constitution as described, the interval of dropping of oil droplets is prolonged, and dropping of oil droplets can be detected easily.

In the above-described oil-cooled type compressor, said oil detection means can be constituted by comprising a heat conductor, said heat conductor being installed at a position where the oil separated by said second oil separation means drops, a temperature detector for detecting a temperature of said heat conductor, and a heater for heating said heat conductor, said heater being controlled so that in the state that the oil separated by said second separation means is not dropped, the temperature of said heat conductor is maintained approximately constant. Preferably, there is constituted so that the heat conductor has its lower part to have an elongated shape so as to lead oil downward from the heater or the portion connected with the temperature detector.

By the constitution as described, the oil detection means can be realized by a simple constitution, and is inexpensive and maintenance thereof is facilitated.

Preferably, an oil-proof agent is coated on the heat conductor. With this, liquid is not adhered to the heat transfer plate, and the temperature is recovered quickly. Accordingly, even where the interval of dropping of oil droplets is short, it is possible to detect the dropping of oil droplets.

Further, in the oil-cooled type compressor, there can be constituted so that said oil detection means comprises a load cell, said load cell detecting the shock force when the oil dropped from said second oil separation means impinges upon said oil detection means.

Further, in the oil-cooled type compressor, there can be constituted so that said oil detection means comprises a thin plate supported in a cantilever fashion, said thin plate being installed so that oil separated by said second oil separation means drops on the free end thereof, and a strain gage, said strain gage detecting vibrations of said thin plate.

In the oil-cooled type compressor, there can be constituted so that said calculating portion obtains the oil content from the interval in which the electric signal changes.

Further, in the oil-cooled type compressor having oil detection means comprising a heater and a heat conductor, there can be also constituted so that said calculating portion obtains the oil content from the temperature dropping amount per unit time. By the constitution as described, even where the interval of dropping of oil droplets is so short that the temperature cannot be recovered, the dropping of oil droplets can be detected easily.

In the oil-cooled type compressor, there can be constituted to have a siphon, said siphon storing oil dropped from said second oil separation means and flowing out the stored oil so as to come in contact with said oil detection means. Thereby, even where the quantity of oil separated from the second oil separation means is large, the percentage content of oil can be obtained accurately.

Further, in the oil-cooled type compressor, there can be constituted so as to comprise an oil absorbing member, said oil absorbing member being provided downward of said second oil separation means to absorb oil separated by said second oil separation means, and an electric resistance detection means for detecting the electric resistance of said oil absorbing member. With this, even where the quantity of oil separated by the second oil separation means is small, the percentage content of oil can be obtained accurately.

Further, in the oil-cooled type compressor, there can be constituted so as to comprise a flow rate detection means provided on said inspecting flow passage, said flow rate detection means detecting the flow rate of said compressed gas flowing through said inspecting flow passage. The calculating portion calculates the percentage content of oil of said compressed gas using the flow rate detected by said flow rate detection means. Further, there can be constituted so as to comprise a flow rate control means provided on said inspecting flow passage. Said flow rate control means controls the flow rate of the compressed gas flowing through said inspecting flow passage in response to an electric signal from said oil detection means. By the constitution as described, it is possible, while controlling such that for example, where the interval of dropping is long, the flow rate of gas flowing through the inspecting flow passage is increased, and where the interval of dropping is short, the flow rate of gas flowing through the inspecting flow passage is decreased, to measure the flow rate thereof to obtain the percentage content of oil. Thereby, the interval for computing the percentage content of oil is approximately constant, and where the obtained percentage content of oil is used for controlling the compressor or the like, the stabilized control becomes enabled.

DESCRIPTION OF THE PREFERRED EMBODIMENTS

The preferred embodiments of the present invention will be explained hereinafter with reference to the accompanying drawings.

Figure 1:
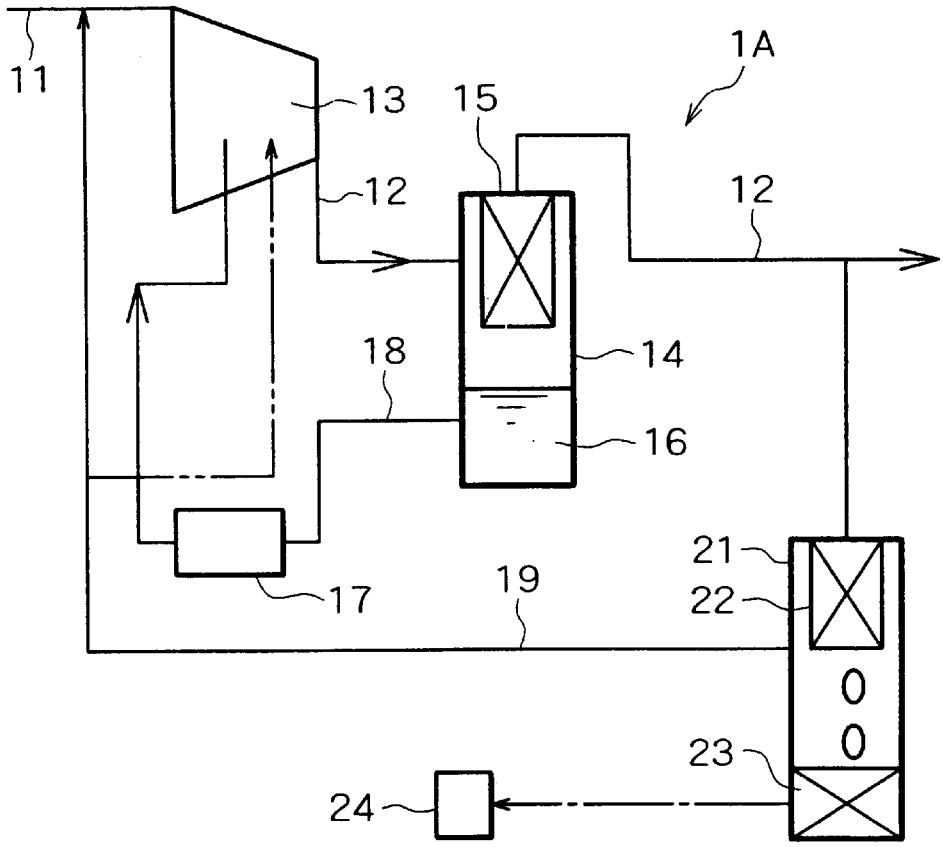
FIG. 1 is a view showing the entire construction of an oil-cooled type compressor according to a first embodiment of the present invention.

FIG. 1 shows an oil-cooled type compressor 1A according to a first embodiment of the present invention. The oil-cooled type compressor 1A is provided with a compressor body 13 having a suction flow passage 11 and a discharge flow passage 12 connected on one side and the other side, respectively, thereof, for example, a screw type compressor body, the discharge flow passage 12 having an oil separation recovering portion 14 interposed therein. The oil separation recovering portion is internally provided with an oil separating element 15, and from an oil reservoir 16 below the oil separation recovering portion 14 extends an oil flow passage 18 for leading oil in the oil reservoir 16 to a gas compression space within the compressor body 13 and oiling parts such as bearing/shaft seal portions within the compressor body 13 through an oil cooler 17. Further, there is provided an inspecting flow passage 19 branched from a portion of the discharge flow passage 12 on the secondary side of the oil separation recovering portion 14 to join with the suction flow passage 11 which is a part lower in pressure than the mentioned branched point, the inspecting flow passage 19 being provided with an oil separation detector 21 constituting the main portion of a liquid quantity calculating device called in the present invention. Alternatively, the inspecting flow passage 19 may be provided so as to communicate with the gas compression space within the compressor body 13 which is a part lower in pressure than the mentioned branched point, as shown by the dash-dotted contour lines in FIG. 1.

Gases taken into the compressor body 13 from the suction flow passage 11 are compressed while being oiled from the oil flow passage 18, and discharged toward the oil separation recovering portion 14 along with oil. In the oil separation recovering portion 14, vigorously flowing-in gases are separated from relatively large-diameter oil particles during the course of repeating collision and reflection, the separated oil drops into the oil reservoir 16, and the compressed gases along with the remaining oil pass through the oil separating element 15. In this course, finer oil particles are captured, and the compressed gases flow out toward the portion of the discharge flow passage 12 continuous to the secondary side of the oil separation recovering portion 14. Normally, in the oil separating element 15, oil is separated until the percentage content of oil will be about 0.5 ppm (wt). The oil captured by the oil separating element 15 gradually drops into the oil reservoir 16 and is stored therein. The oil in the oil reservoir 16 is sent to the oiling part through the oil flow passage 18, after which it repeats circulation.

Incidentally, at the upper part within the oil separation detector 21 is provided, for separating oil particles from the compressed gas flowing through the inspecting flow passage 19, an oil separating element 22 capable of capturing finer oil particles, as compared with the oil separating element 15, and capable of separating oil till the percentage content of oil in the gases is about 0.01 ppm (wt), as compared with the oil separating element 15. The compressed gas branched from the discharge flow passage 12 and flown into the oil separation detector 21 passes through the oil separating element 22 provided at the upper part within the casing through an inlet provided at the upper part of the casing of the oil separation detector 21, and flows outside the oil separation detector 21 through an outlet provided at the upper part (in the illustration, upper and sideward) of the casing of the oil separation detector 21 and flows into the suction flow passage 11. Further, at the lower part within the oil separation detector 21 is provided an oil droplet detection means 23 for receiving oil droplets dropped from the oil separating element 22 and outputting a signal indicative of a change of state electrically when receiving the oil droplets, and an electric signal therefrom is input into a calculating section 24. An oil discharge means not shown is provided on the bottom surface of the oil separation detector 21.

Material for the oil separating elements 15 and 22 is cellulose fibers. In the oil separating elements 15 and 22, to what extent of fine oil particles can be captured is determined by roughness of the cellulose fibers. The roughness of the cellulose fibers may be suitably selected so that the percentage content of oil is lowered as necessary. In the oil separating elements 15 and 22, where there occurs a problem in terms of strength merely by the cellulose fibers, there can be employed the constitution in which the cellulose fibers are peripherally provided on a cylindrical punching metal (a porous sheet metal) or a cylindrical metal mesh.

A fine quantity of compressed gas is led to the oil separation detector 21, but it is contemplated that the percentage content of oil of the compressed gas is equal to that in the portion of the discharge flow passage 12 on the secondary side of the oil separation recovering portion 14. Further, the oil quantity of the oil droplets is approximately constant, the oil quantity contained in the compressed gas is calculated from the interval of an electric signal indicative of the change of state as described above, and the calculated result is output.

The calculation of the oil quantity described above will be explained specifically hereinafter.

For example, suppose that the flow rate of gas (molecular weight: 29) passing through the oil separating element 22 is 50 $Nm^3$/hr, where the percentage content of oil of the gas is 0.5 ppm (wt), the flow rate of oil is obtained from the following equation.

$$50 \cdot 29/22.4 \cdot 0.5 \cdot 10^{-6} = 32.4 \cdot 10^{-6} \text{ (kg/hr)}$$

$$= 3.76 \cdot 10^{-2} \text{ (cc/hr)} \qquad \text{Equation 1}$$

Normally, the oil quantity of one oil droplet is about 0.04 cc, and one oil droplet is to be dropped in about 1.1 hours (0.04÷0.0376=1.06 (hr)). Accordingly, the interval in which oil droplets drop is measured whereby the flow rate (cc/hr) of oil accompanied by gas can be obtained by the following equation counting backwards from the interval:

Flow rate (cc/hr) of oil accompanied by gas=0.04 (cc)/interval in which oil droplets drop (hr).

Then, the interval is measured whereby the percentage of content of oil in the gas can be calculated continuously.

The weight flow rate (kg) of gas passing through the oil separating element 22 during the oil-droplet dropping interval can be obtained by the following equation.

$$W=Q\cdot M\cdot t/22.4 \quad \text{Equation 2}$$

wherein

Q: The flow rate of gas passing through the oil separating element 22 ($Nm^3/hr$)

M: Molecular weight of gas

The weight of oil of one droplet G (kg) is obtained by the following equation.

$$G=q\cdot\rho/1000 \quad \text{Equation 3}$$

wherein q: One oil droplet quantity (cc)

ρ: Oil density (g/cc)

And, the percentage content of oil of the gas α (ppm (wt)) is obtained by the following equation.

$$\alpha=G/W\cdot 10^6 \quad \text{Equation 4}$$

In this manner, the percentage content of oil of the gas α can be calculated, and the calculated value is output, for example, displayed whereby the quantity of oil accompanied by the compressed gas can be monitored continuously to prevent an occurrence of trouble which occurs when the oil abnormally increases.

Figure 2:
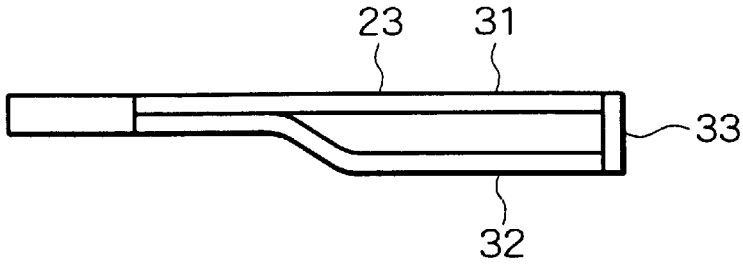
FIG. 2 is a view showing one example of an oil droplet detection means in the oil-cooled type compressor shown in FIG. 1.
Figure 3:
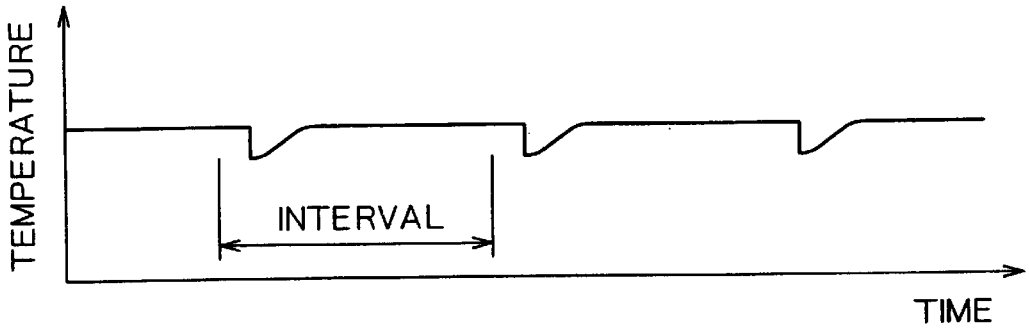
FIG. 3 is a view showing the state of a change of temperature obtained on the basis of a signal from the oil droplet detection means shown in FIG. 2.

FIG. 2 shows one example of the oil droplet detection means. The oil droplet detection means 23 is formed by a thermocouple or a thermistor 31, a heater 32 extended therebelow, and a heat transfer plate 33 connected to respective ends thereof. The heat transfer plate 33 consists of a heat conductor. The heat transfer plate 33 is arranged at a position where the temperature of the heat transfer plate 33 is maintained at a constant temperature higher than the temperature of oil droplets being dropped, that is, a control temperature Tc by the heater 32, and the oil droplets drop. When the oil droplets drop on the heat transfer plate 33, the heat transfer plate 33 is cooled temporarily every time they drop, and the temperature detected by the thermocouple or the thermistor 31 changes. Even if the heat transfer plate 33 is cooled by the oil droplets, since the temperature is controlled by the heater 32, the temperature is returned to the control temperature Tc after a while. Accordingly, the changing temperature is measured to thereby know the state that the temperature of the heat transfer plate 33 changes. FIG. 3 shows the state of the change of temperature. It is regarded that when the temperature lowers than the constant control temperature Tc, the oil droplets dropped, and the above-described percentage content of oil can be obtained from the dropping interval.

However, if the dropping interval of oil droplets is short, there occurs the case where next oil droplets drop before the temperature is returned to the control temperature by the heater 32. In this case, since the temperature of the heat transfer plate 33 is lower than the control temperature Tc, the presence or absence of the dropping of oil droplets cannot be judged merely by the fact that the temperature of the heat transfer plate 33 lowers from the control temperature. So, in this case, it is regarded that when the temperature lowering amount (ΔT) per unit time (Δt), that is, the temperature lowering speed (ΔT/Δt) exceeds a fixed value, the dropping of oil droplets occurs, whereby the aforementioned inconvenience is overcome.

Figure 4:
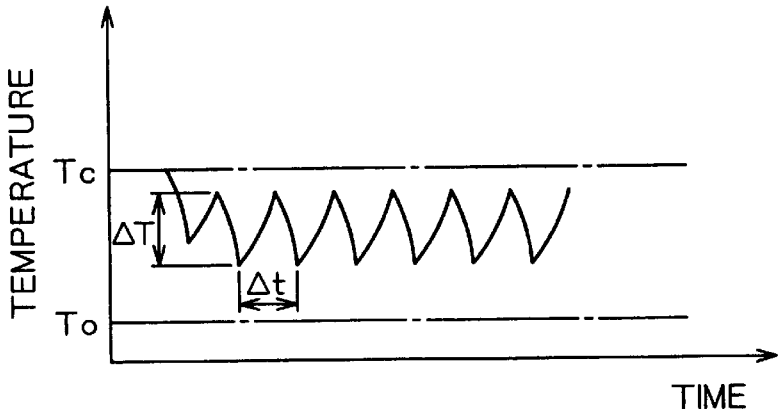
FIG. 4 is a view, where an interval of oil-droplet dropping time is short, showing the state of a change of temperature obtained on the basis of a signal from the oil droplet detection means shown in FIG. 2.

In FIG. 4, To means an oil temperature.

Figure 5:
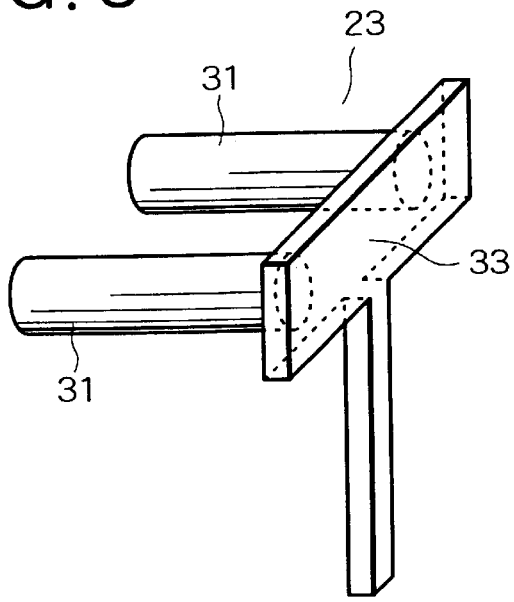
FIG. 5 is a view showing a further example of the oil droplet detection means in the oil-cooled type compressor shown in FIG. 1.

It is desired that the oil droplets dropped on the heat transfer plate 33 flow down from the heat transfer plate 33 smoothly without staying on the heat transfer plate 33 for a long period of time. To this end, it is preferred that as shown in FIG. 5, the heat transfer plate 33 is formed into a T-shape in which is extended elongated-shaped thin metal, for example, such as a wire for leading oil downward from the joined part between the thermocouple or the thermistor 31, and it is desired that a liquid-proof agent, for example, an oil-proof agent (example: ethylene tetra-fluoride resin) is coated the surface.

Figure 6:
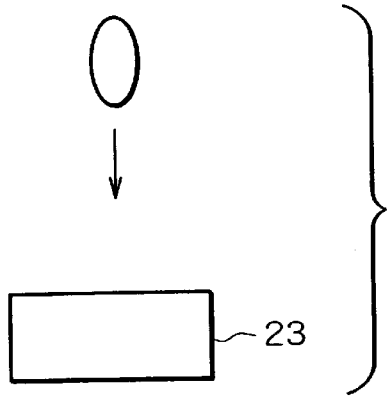
FIG. 6 is a view showing another example of the oil droplet detection means in the oil-cooled type compressor shown in FIG. 1.
Figure 7:
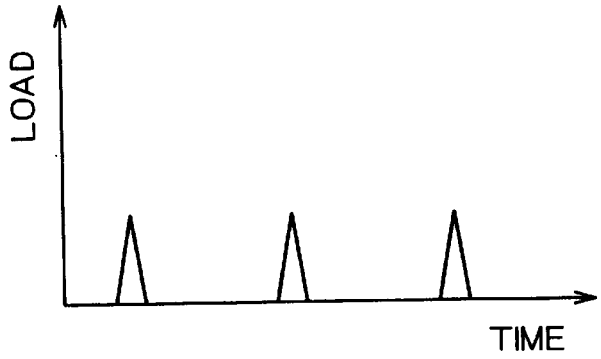
FIG. 7 is a view showing the state of a change of load obtained on the basis of a signal from the oil droplet detection means shown in FIG. 6.

Further, a load cell may be used as the oil droplet detection means 23 as shown in FIG. 6. The shocking force when the oil droplets drop on the oil droplet detection means 23 is detected by the oil droplet detection means 23, an electric signal indicative of the load change as shown in FIG. 7 is output from the oil droplet detection means 23 as shown in FIG. 7, and the aforementioned percentage content can be obtained from the interval of the load change.

Figure 8:
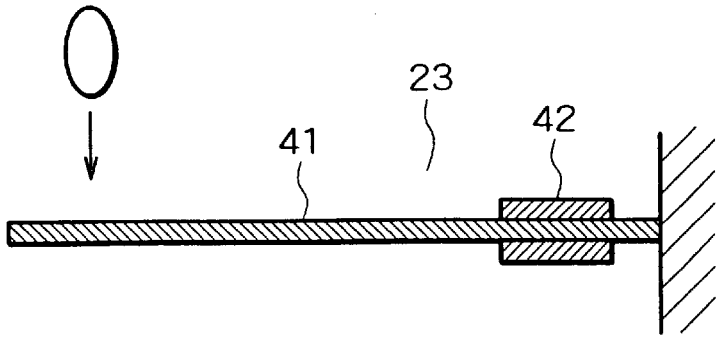
FIG. 8 is a view showing another example of the oil droplet detection means in the oil-cooled type compressor shown in FIG. 1.

Further, alternatively, in the oil droplet detection means 23, as shown in FIG. 8, a thin plate 41 is supported in a cantilever fashion, a strain gage 42 is mounted in the vicinity of the thin plate 41, and oil droplets drop on the free end of the thin plate 41.

Figure 9:
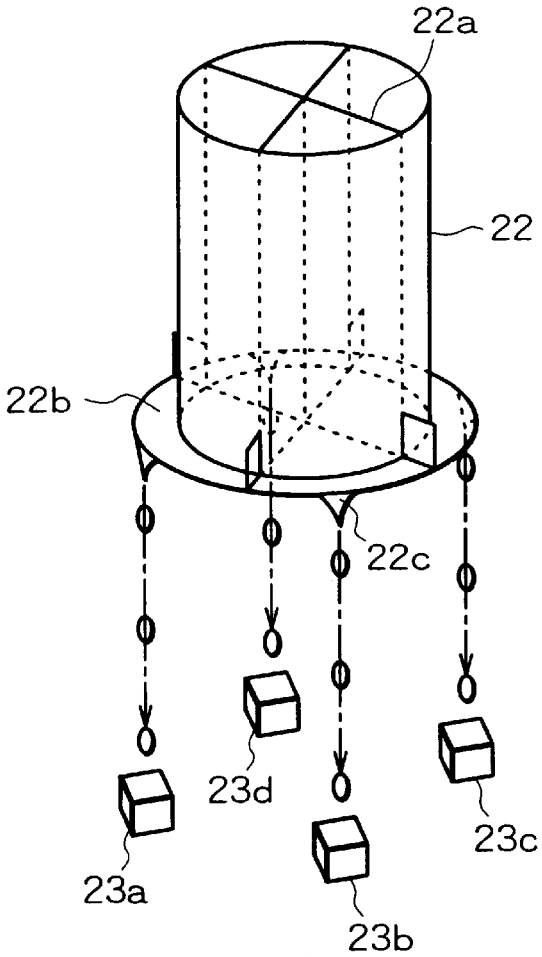
FIG. 9 is a view showing yet another example of the oil droplet detection means in the oil-cooled type compressor shown in FIG. 1.

In this case, when the oil droplets drop on the thin plate 41, the thin plate 41 vibrates, and strain resulting from the vibration is detected by a strain gage 42, and an electric signal corresponding to the strain is output, whereby the aforementioned percentage content can be obtained from the intervals of the change in the electric signal can be obtained.

Where a large quantity of oil is contained in the gas, since the dropping interval of oil droplets is short, the interval cannot be sometimes detected by the droplet detection means as described above. The detection of the interval in this case can be overcome, if the oil quantity is not very large, by providing a plurality of dropping positions of oil droplets caused to be dropped from the bottom of the oil separating element 22, and providing oil droplet detection means thereon. For example, there is used an oil separating element 22 whose section perpendicular to the axis is divided into four by an axially extending partitioning wall 22*a* as shown in FIG. 9. The partitioning wall 22*a* also projects toward the upper surface of a flange portion 22*b* provided on the outer circumference of the bottom of the oil separating element 22*a* so that oil captured at the four-divided parts is prevented from being mixed, where by the oil captured and separated at those parts become oil droplets which drop from the separate positions. Further, a projecting portion 22*c* which is convergent downward is provided on the lower surface of the oil separating element 22 so that oil separated at the above parts may drop from the respective fixed positions. And, oil droplet detection means 23*a*, 23*b*, 23*c* and 23*d* are provided at the respective dropping positions of oil droplets whereby the dropping time of oil droplets is extended by four times as compared with the case of a single oil droplet detection means 23 to enable detection of the interval in the case mentioned above.

Figure 10:
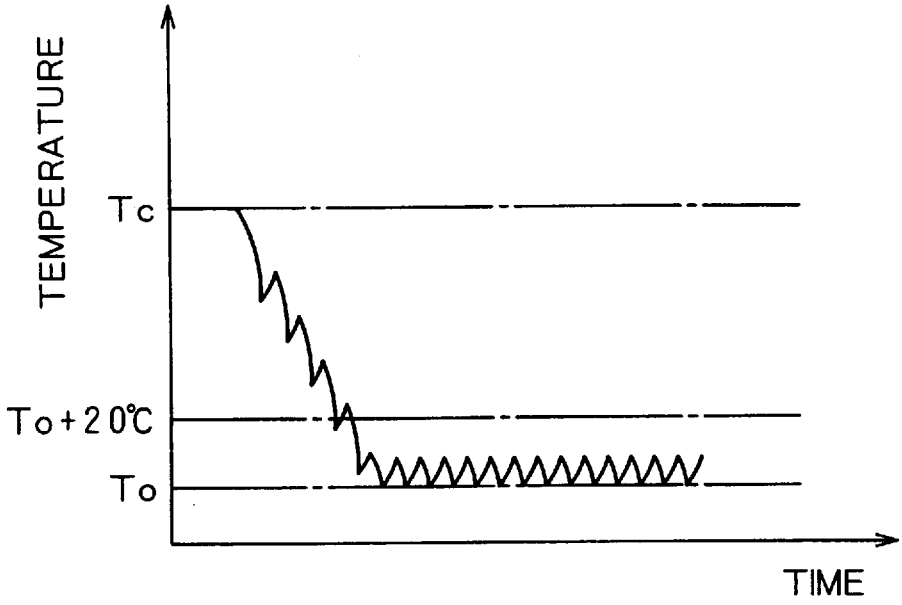
FIG. 10 is a view, where an interval of oil-droplet dropping time is so short that the detection of oil-droplet dropping is disabled, showing the state of a change of temperature obtained on the basis of a signal from the oil droplet detection means shown in FIG. 2.

However, when the oil quantity is very large, the limit of the interval detection of the dropping of oil droplets by the division of the oil separating element described above sometimes exceeds. For example, where oil droplet detection means 23 comprising a heat generating body having a heat transfer plate 33 joined to the end of a heater 32 and a temperature detector comprising a thermocouple or a thermistor 31 is used, when the oil quantity is excessively large, the temperature detected by the temperature detector becomes approximately equal to the oil temperature with the passage of time, as shown in FIG. 10, failing to detect the oil droplets. That is, the state that the detected temperature becomes approximately equal to the oil temperature is apparently the same as the state that oil is not contained in the gas, and these two states cannot be discriminated.

So, where the temperature detected by the temperature detector is below a certain temperature, and the oil droplets are not detected, judgment is made so that the oil quantity in the gas is so large as to exceed the detection limit. In FIG. 10, let Tc be the control temperature and To be the oil temperature, where the oil quantity is large, the temperature detected by the temperature detector is a value close to the oil temperature To. On the other hand, the minimal interval t1 that can be detected by the oil droplet detection means can be obtained in advance by experiments or the like.

So, where for example, the temperature detected by the temperature detector is below T2+20° C., and the oil droplets are not detected even after passage of time t1 or more, judgment is made that the oil droplets cannot be detected at the interval t1 or less. In this case, it means that the oil quantity contained in the gas is not less than a value of α1 (ppm(wt)) expressed by the following equation.

$$\alpha 1 = G/W1 \cdot 10^6 = G/((Q \cdot M \cdot t1/22.1) \cdot 10^6) \quad \text{Equation 5}$$

Further, also in the case where the value of the α1 is used for control or the like, control is made in consideration of the value of the α1.

Contrarily, where the oil quantity is small, the interval of dropping of oil droplets is so long that the interval capable of counting the percentage content of oil in the gas becomes lengthened. In this case, judgment whether or not the apparatus is abnormal cannot be made. So, where the detection temperature by the temperature detector is a certain value, for example, in excess of Tc−20 (° C.), and the dropping of oil droplets is not detected even after passage of a fixed time t2 or more, it is regarded that the oil quantity contained in the gas is not more than α2 (ppm(wt)) expressed by the following equation.

$$\alpha 2 = G/W2 \cdot 10^6 = G/((Q \cdot M \cdot t2/22.1) \cdot 10^6) \quad \text{Equation 6}$$

Accordingly, the indication of oil quantity is α2 (ppm (wt)).

The oil quantity of one droplet differs depending on the surface tension which is changed by the oil temperature, and is changed by the oil temperature. This oil temperature is approximately the same as the gas temperature. Accordingly, the aforementioned one oil droplet quantity q (cc) is changed by the gas temperature. Therefore, a relation between the oil temperature and the one oil droplet quantity q is obtained in advance, the temperature of the gas flowing into the oil separation detector 21, or the gas within the oil separation detector 21 is measured, and one oil droplet quantity q obtained on the basis of the above-measured temperature is employed in the aforementioned equation whereby the percentage content of oil can be calculated more accurately.

Figure 11:
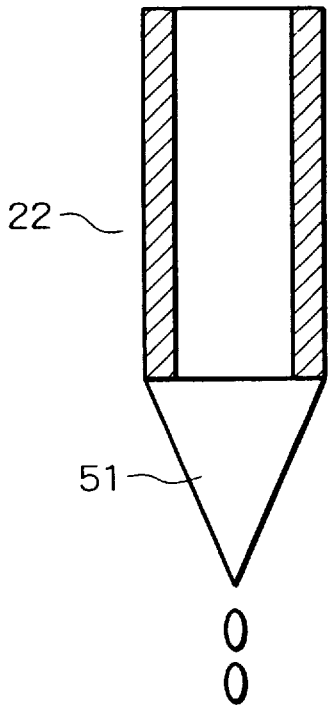
FIG. 11 is a view showing a further example of an oil separating element within an oil separation detector in the oil-cooled type compressor shown in FIG. 1.
Figure 12:
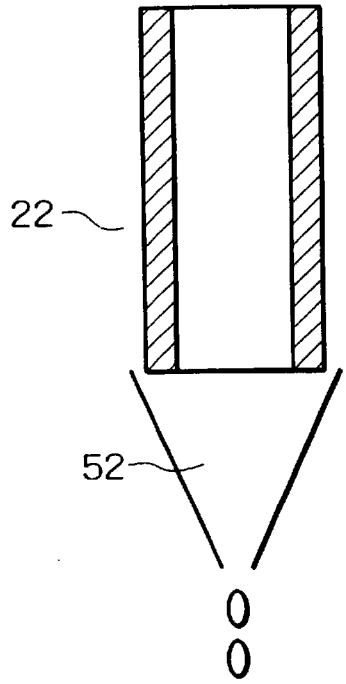
FIG. 12 is a view showing another example of an oil separating element within an oil separation detector in the oil-cooled type compressor shown in FIG. 1.
Figure 13:
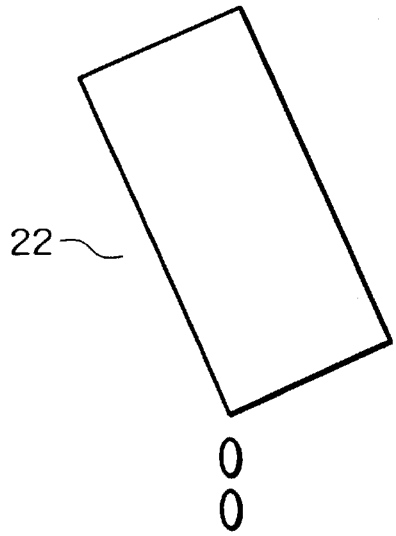
FIG. 13 is a view showing yet another example of an oil separating element within an oil separation detector in the oil-cooled type compressor shown in FIG. 1.

As will be apparent from the above-described explanation, it is important for calculating the percentage content to always drop oil droplets on the fixed position from the oil separating element 22. To this end, preferably, the oil separating element 22 is made to have a shape provided with a conical body 51 at the lower part as shown in FIG. 11, or preferably, a funnel 52 is provided, as shown in FIG. 12, so that the oil droplets drop along the inner surface of the funnel 52. Alternatively, the oil separating element 22 may be provided to be inclined, as shown in FIG., 13, so that the oil droplets drop from one point of the corner at the lowermost end.

The oil quantity of one droplet greatly depends upon the shape of the position from which the oil droplets drop, and where the curvature of oil droplets is large, the oil quantity is small, while where the curvature is small, the oil quantity increases. Accordingly, where the curvature of the outer circumference whose section is perpendicular to the axis at the lower end is large as shown in FIG. 11, the interval of the dropping of oil droplets becomes short. Therefore, sometimes, the dropping of the oil droplets cannot be detected. So, as shown in FIG. 14, a portion on which oil droplets of the oil separating element 22 drop is formed to be spherical. As a result, in case of the oil separating element 22 shown in FIG. 14, the curvature of the outer circumference whose section is perpendicular to the axis at the lower end is small, as compared with the case of the conical shaped oil separating element shown in FIG. 11, and further even if a position on which oil droplets drop is changed due to an error in mounting angle of the oil separating element 22, the curvature is constant because the lower part of the oil separating element 22 is shaped to be spherical, and the oil quantity of one droplet is always constant as long as the oil droplets vertically flow down along the spherical portion smoothly. And, as described in detail hereinafter, a slit 25 is formed in the spherical portion at the lower part of the oil separating element 22 in order to make the dropping of the oil droplets smooth.

Figure 14A:
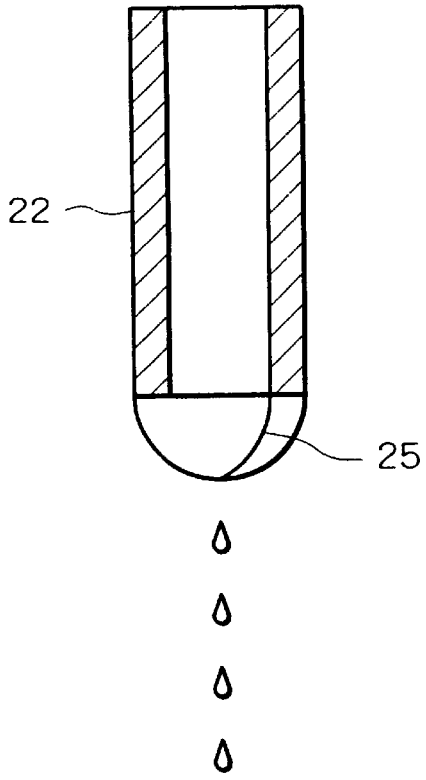
FIGS. 14A and 14B are views showing another example of an oil separating element within an oil separation detector in the oil-cooled type compressor shown in FIG. 1.
Figure 14B:
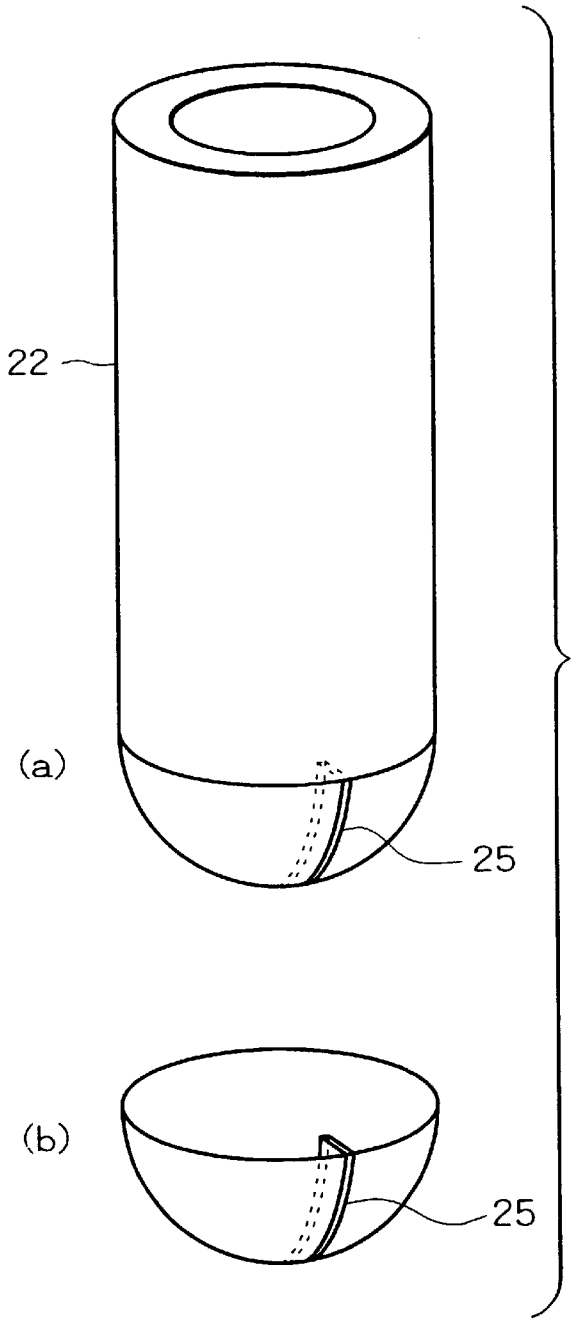

FIG. 14A is a sectional view of the oil separating element 22, and FIG. 14B is a perspective view of the oil separating element 22. As shown, in the oil separating element 22, a spherical body is attached to the cylindrical element.

In the course that the oil-contained gas flows from inside to the outside of the element 22, oil is captured in the oil separating element 22. The oil captured in the oil separating element 22 is urged by the flow of the gas and seeps out on the surface of the cylindrical portion of the oil separating element 22.

Figure 15:
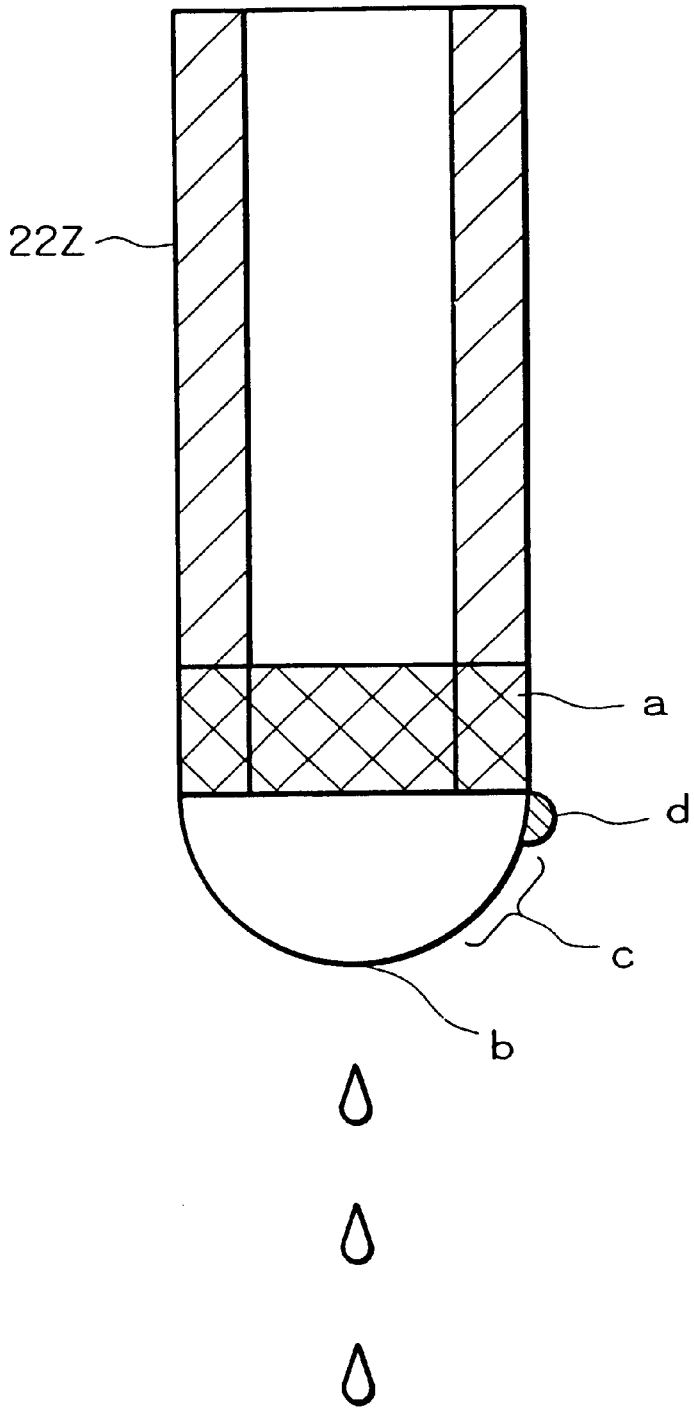
FIG. 15 is a view for explaining the state where a slit of the oil separating element shown in FIG. 14 is not present.

One condition for making one oil droplet quantity constant is that when the oil separated by the oil separating element 22 reaches the above-described oil quantity, the oil drops in the form of oil droplets without delay of time. Therefore, it is necessary that the oil separated by the oil separating element 22 causes oil at the oil droplet dropping portion to extrude. In case of an oil separating element 22Z shown in FIG. 15 having no slit, different from the oil separating element 22 having the slit 25 shown in FIG. 14, the oil separated here moistens the surface of the bottom a, and drops as an oil droplet at the lowermost point b of the spherical portion, but a dry portion c which is not moistened by oil between the bottom a and the point b is sometimes present. In this case, the oil at the bottom does not flow down on the lowermost point b smoothly but once stops at a part d on the upper end of the dry portion c due to the surface tension, not affecting on the growth of the oil droplets at the lowermost point b. And, when oil stays to some extent at the part d, the oil flows down to the lowermost point b in one go, and drops from the lowermost point b. Because of this, the one oil droplet quantity and the dropping interval are irregular.

On the other hand, in case of the oil separating element 22 shown in FIG. 14, the slit 25 is formed, and the slit 25 is always filled with oil and is never dried. Therefore, in the oil separating element 22 shown in FIG. 14, the oil separated from the gas is not stayed but gradually flows toward the lowermost part of the spherical portion, and the above-mentioned inconvenience in the case of the oil separating element 22Z shown in FIG. 15 can be avoided.

While in FIG. 14, the slit 25 is constituted merely on one side in connection with the lowermost point of the spherical body, it is to be noted that the slit(s) 25 passes through the lowermost end of the spherical body and may be present on both sides in connection with the lowermost point. With respect to the width of the slit 25, for example, where the radius of curvature of the spherical portion is 10 mm, approximately 1.5 mm is suitable. The magnitude of the width may be suitably adjusted according to the kind of oil (viscosity or the like). Even in maximum, the width is about 3.0 mm.

Figure 16:
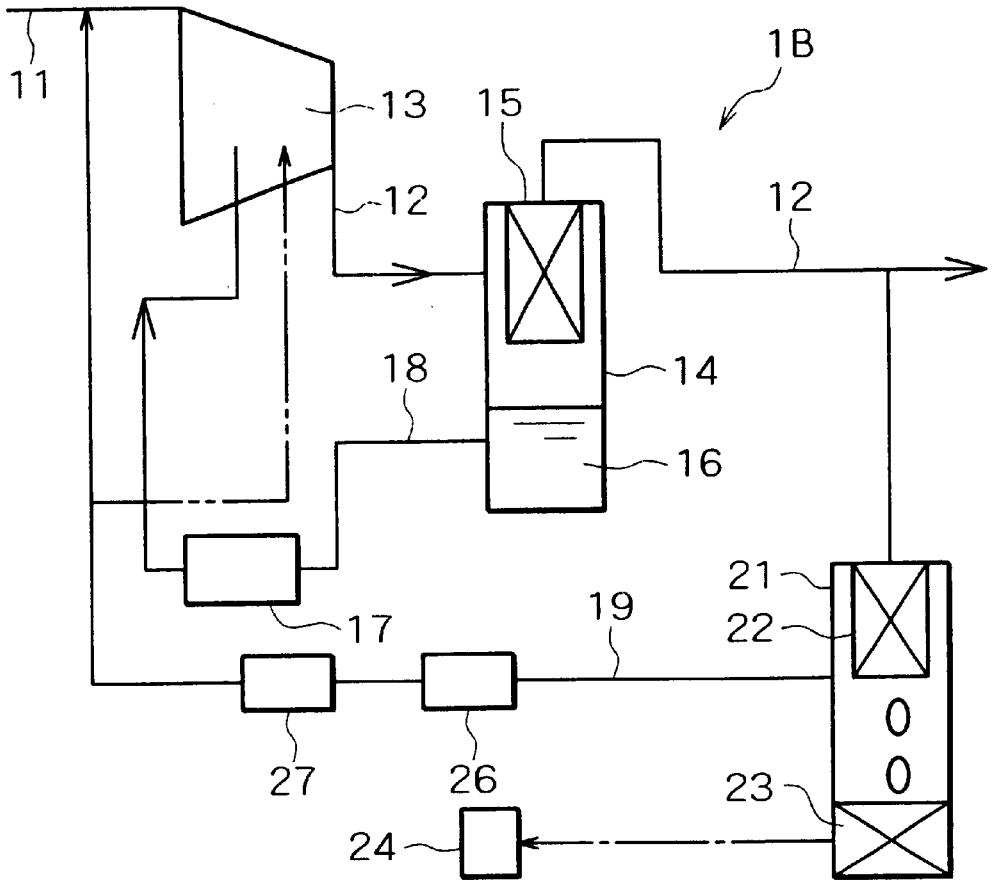
FIG. 16 is a view showing the entire construction of an oil-cooled type compressor according to a second embodiment of the present invention.

FIG. 16 shows an oil-cooled type compressor 1B according to a second embodiment of the invention. Parts common to those of the oil-cooled type compressor 1A shown in FIG. 1 are designated by the same reference numerals, description of which will be omitted.

In the oil-cooled type compressor 1B, an inspecting flow passage 19 is provided with a flow rate measuring means 26 and a flow rate control means 27. The flow rate measuring means 26 is provided because the gas flow rate necessary for computing the percentage content always changes, and the measured value by the flow rate measuring means 26 is employed as the gas flow rate in the above-described computation. Further, the flow rate of gas passing through the oil separation detector 21 is controlled by the flow rate control means 27 on the basis of the interval of oil-droplet dropping.

As an example, the lower limit and the upper limit of the interval of oil-droplet dropping are determined to be $t_L$ and $t_U$ ($t_U > t_L$), respectively. When the interval of oil-droplet dropping is less than $t_L$, the flow rate of gas is reduced by the flow rate control means 27. As a result, since the oil quantity contained in the gas reduces also, the interval of oil-droplet dropping is prolonged. On the other hand, when the interval of oil-droplet dropping exceeds $t_U$, the flow rate of gas is increased by the flow rate control means 27. As a result, since the oil quantity contained in the gas reduces also, the interval of oil-droplet dropping is shortened. As described, in this oil-cooled type compressor 1B, the interval of oil-droplet dropping is always maintained between $t_L$ and $t_U$.

In the present invention, since the percentage content is calculated on the basis of the interval of oil-droplet dropping, the interval of the computation coincides with the interval of oil-droplet dropping. Therefore, where the calculated value of the percentage content is used for controlling the compressor or the like, updating of the percentage content of oil is irregular in time, posing a problem in controllability, but in the oil-cooled type compressor 1B, since the interval of oil-droplet dropping is maintained within a fixed range, such a problem as mentioned does not occur.

Figure 17:
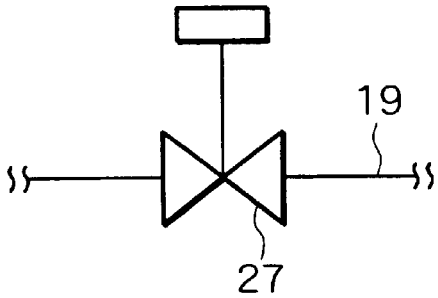
FIG. 17 is a view showing a specific example of a flow-rate control means in the oil-cooled type compressor shown in FIG. 16.
Figure 18:
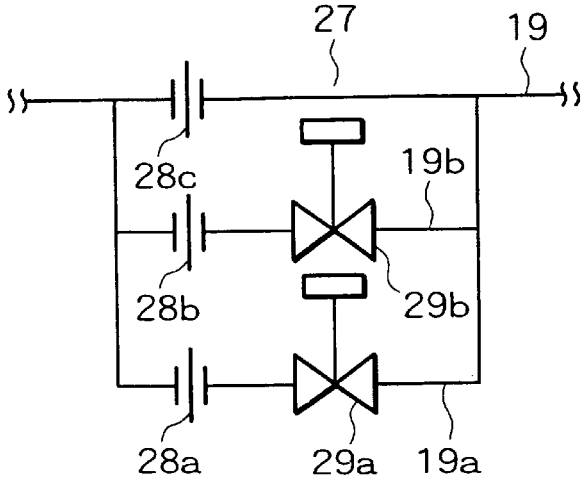
FIG. 18 is a view showing a further specific example of a flow-rate control means in the oil-cooled type compressor shown in FIG. 16.

FIGS. 17 and 18 illustrate the specific constitution of the flow rate control means 27.

In FIG. 17, there is shown a flow rate control means 27 formed by a single flow rate control valve capable of controlling an opening degree provided on the inspecting flow passage 19.

Further, in FIG. 18, there is shown a flow rate control means 27 formed such that flow passage portions 19*a* and 19*b* which are branched from an inspecting flow passage 19 and afterward joined with the inspecting flow passage 19 are provided in parallel, a throttle means 28*a* such as an orifice and an electromagnetic type open-close valve 29*a* are provided on the flow passage portion 19*a* and a throttle means 28*b* and an electromagnetic type open-close valve 29*b* similar to the former are provided on the flow passage portion 19*b*, and a throttle means 28*c* similar to the former is provided on the portion of the inspecting flow passage 19 between the branched point and the joined point.

Needless to say, the flow rate control means 27 is not limited to the above-described constitution, but the number of the flow passage portions branched from the inspecting flow passage 19 and joined with the inspecting flow passage 19 may be increased or decreased, and a solenoid type open-close valve may be provided also on the flow passage portion 19*c*.

Figure 19:
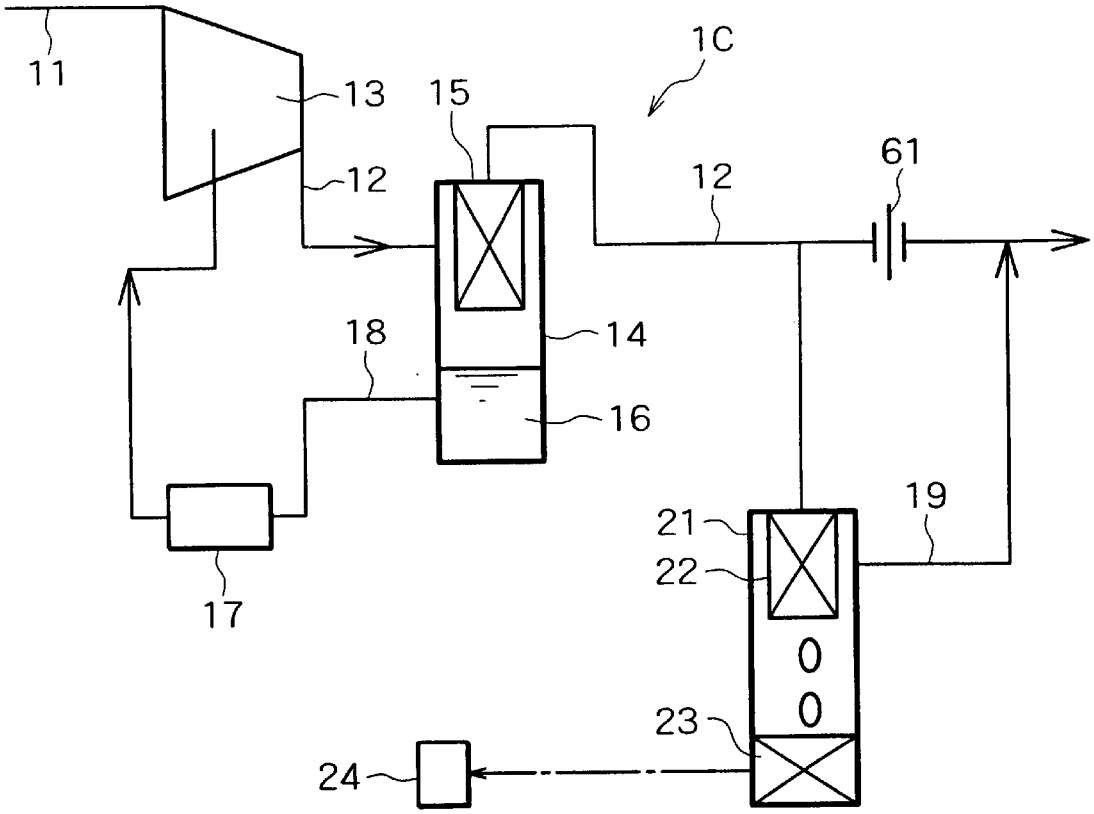
FIG. 19 is a view showing the entire construction of an oil-cooled type compressor according to a third embodiment of the present invention.

FIG. 19 shows an oil-cooled type compressor 1C according to a third embodiment of the present invention. Parts common to those of the oil-cooled type compressor 1A shown in FIG. 1 are indicated by the same reference numerals, description of which is omitted.

In the oil-cooled type compressor 1C, the inspecting flow passage 19 is joined with a portion of a discharge flow passage 12 on the downstream side away from the above-described branched point, a throttle means 61 such as an orifice is interposed between the branched point and the joined point, the joined point being made to be a lower pressure portion than the branched point, and gas may flow toward the joined point within the oil separation detector 21.

In case of the oil-cooled type compressor 1C, there is not brought forth a substantial lowering of the gas flow rate in the compressor body 13 caused by returning part of the compressed gas to the suction flow passage 11.

As described, the inspecting flow passage 19 may be provided so as to communicate with the lower pressure portion than the above-described branched point, and the present invention includes also an oil-cooled type compressor in which the inspecting flow passage 19 is provided so as to communicate with the atmosphere which is the lower pressure portion than the above-described branched point.

Further, needless to say, the oil droplet detection means 23 shown in FIGS. 2, 5 and 6, and the oil separating elements shown in FIGS. 11, 12, 13 and 14 can be also applied to the oil-cooled type compressor 1C.

Where water drain is mixed into gases, there is a possibility that not only dropping of oil droplets but also dropping of water droplets are measured. So, preferably, the conical body 51 shown in FIG. 11, or the funnel 52 shown in FIG. 12, or the spherical part of the lower part of the oil separating element 22 is heated by a heater whereby water is vaporized and only oil is remained so as to prevent the water droplets from being measured erroneously.

Incidentally, while in the foregoing, the apparatus and method for calculating the liquid quantity contained in the gas on the basis of the interval in which liquid droplets drop from the liquid separating element have been explained, it is to be noted that where the liquid quantity is very large, and where the liquid quantity is very small contrary thereto, the liquid quantity may be calculated in the following manner.

Figure 20:
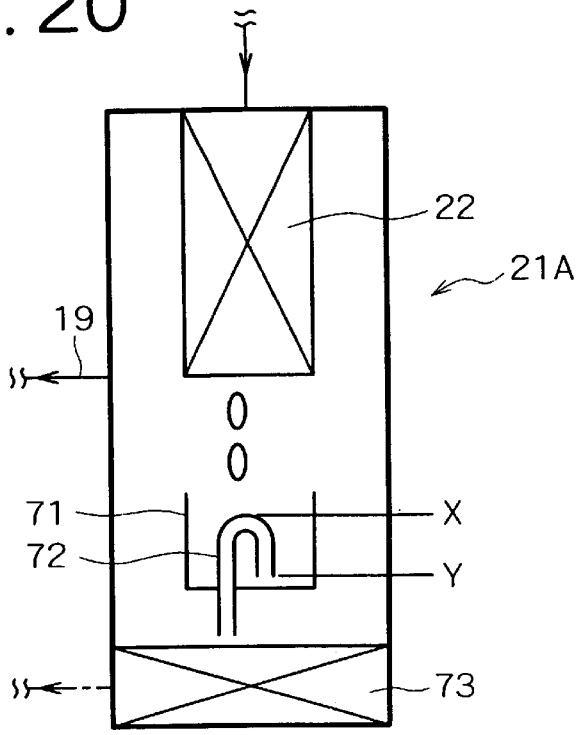
FIG. 20 is a view showing a further oil separation detector applied in place of the oil separation detector shown in FIG. 1, 16 or 19.

FIG. 20 shows an oil separation detector 21A in place of the oil separation detector 21 for oil droplet separation and detection in FIG. 1, 16 or 19, parts common to those of FIG. 1, 16 or 19 being indicated by the same reference numerals.

The oil separation detector 21A is applied to the case where the oil quantity contained in the gas is very large, and has, below the oil separating element 22, a container 71, a siphon 72 extending downward of the container 71 from the interior of the container 71, and a liquid outflow detector 73 arranged below the siphon 72.

Similarly to that mentioned above, the oil droplets drop from the oil separating element 22. However, the oil droplets stay within the container 71, and an oil surface level within the container 71 reaches the uppermost part indicated by X in the figure of the siphon 72, oil within the container 71 flows out toward the liquid outflow detector 73 in one go till the oil surface level lowers to the upper end surface indicated by Y in the figure of the siphon 72.

A signal resulting from detection of the outflow of oil is input into the calculating section 24, and the oil quantity contained in the gas is calculated. That is, the oil quantity between the oil surface level indicated by Y within the container 71 and the oil surface level indicated by X is employed in place of the oil quantity of one oil droplet described above, and the interval of the outflow of oil to the liquid outflow detector 73 is employed in place of the interval of dropping of the oil droplets whereby the oil quantity contained in the gas is calculated.

The liquid outflow detector 73 includes the type making use of a laser beam or a load cell, the electrostatic type and the like.

Figure 21:
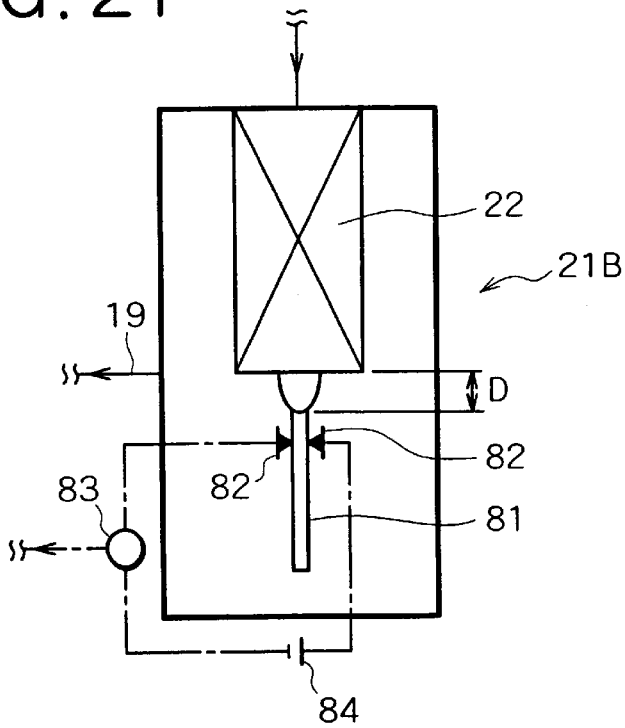
FIG. 21 is a view showing another oil separation detector applied in place of the oil separation detector shown in FIG. 1, 16 or 19.

FIG. 21 shows a further oil separation detector 21B in place of the oil separation detector 21 for oil droplet separation and detection in FIG. 1, 16 or 19, parts common to those of FIG. 1, 16 or 19 being indicated by the same reference numerals.

The oil separation detector 21B is applied to the case where the oil quantity contained in the gas is very small, and an oil absorbing member 81, for example, a non-woven fabric and two electrodes 82, 82 in contact with both sides at the upper part of the oil absorbing member 81 are arranged below the oil separating element 22. A voltage is applied to the two electrodes 82, 82 through an ammeter 83 by a power supply 84.

Figure 22:
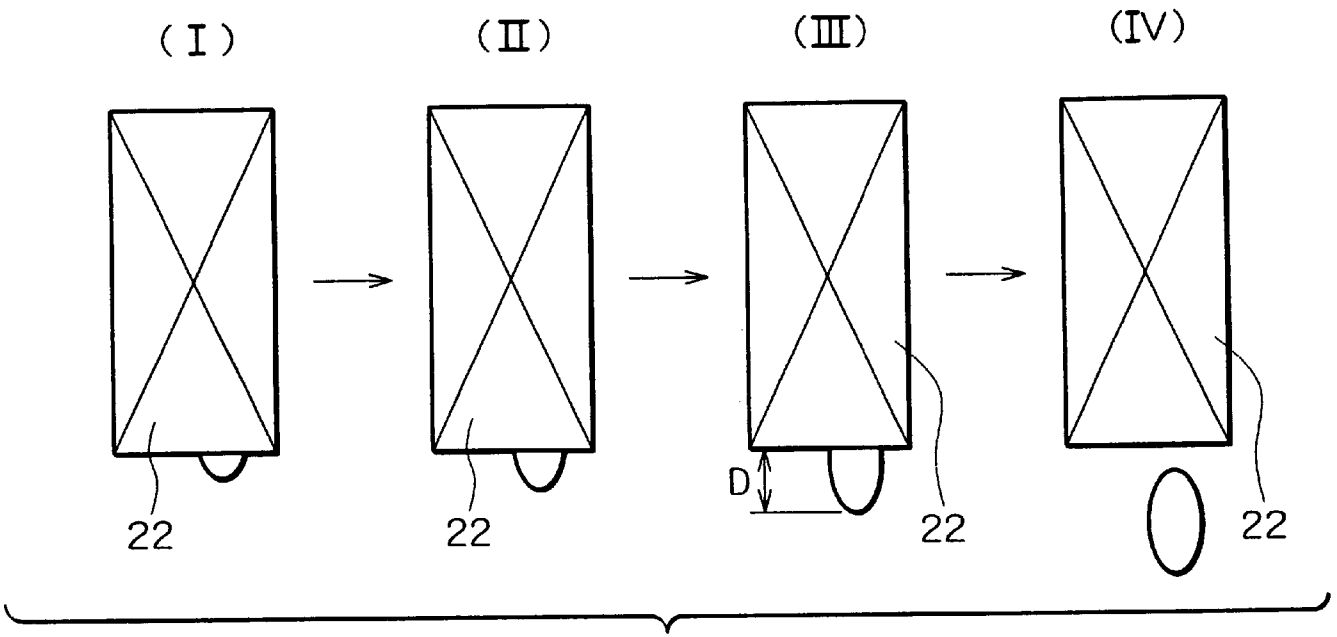
FIG. 22 is a view showing a growing progress of oil droplets at the lower portion of the oil separating element shown in FIG. 21.

As shown in FIG. 22, the oil separated by the oil separating element 22 stays under the oil separating element 22, and states are changed to the states of (I), (II), (III) to enlarge the oil droplets, and at the state of (IV), the oil droplets drop from the oil separating element 22. Incidentally, there is also a case where the oil quantity contained in the gas is very small, and the interval of dropping of oil droplets is a few hours, and it takes excessive time for measuring the above oil quantity from the interval.

So, in the oil separation detector 21B, the oil absorbing member 81 is provided at a position of dimension D at the lower part of the oil separating element 22 so that even if the oil droplets are not dropped, the oil droplets are forcibly absorbed in the state that the oil droplets assume the size of the dimension D as in the state of (III) in FIG. 22.

In other words, in the oil separation detector 21B, a fixed quantity of oil stay at the lower part of the oil separating element 21B, and the whole quantity of the oil stayed in the fixed quantity is discharged to the oil absorbing member 81. When the oil is absorbed by the oil absorbing member 81, the electric resistance of the oil absorbing member 81 between two electrodes 82, 82 lowers, the detected current value at the ammeter 83 increases, and the current signal is input in the calculating section 24. The oil absorbed by the oil absorbing member 81 moves downward, and after a while, the upper part of the oil absorbing member 81 is dried so that the detected current value is returned to the original small value, because of which in the calculating section 24, the oil quantity contained in the gas is calculated on the basis of the interval of the change of current and the oil quantity of oil droplets at the dimension D. That is, the oil quantity of the oil droplets at the dimension D is employed in place of the oil quantity of the one oil droplet described above, and the interval of the change of the detected current value is employed in place of the interval of dropping of the oil droplets whereby the oil quantity contained in the gas is calculated.

It is to be noted that a voltmeter for detecting a voltage between two electrodes 82, 82 may be employed in place of the ammeter 83.

Further, the oil separation recovering portion 14 may be formed by being separated into an oil separation recovering portion for large grains for separation recovering oil droplets of relatively large diameter merely by the collision action and gravity sinking action without housing the oil separating element 15, and an oil separation recovering portion for fine particles for separation recovering oil by capturing finer oil droplets housing the oil separating element 15.

Further, the oil separation detector is not limited to the aforementioned construction housing the oil separating element but the present invention includes even an oil separation detector illustrated hereinafter.

What is claimed is:

1. An oil-cooled compressor, comprising:

a compressor body; a discharge flow passage for leading a compressed gas compressed by said compressor body to outside of said oil-cooled type compressor;

a first oil separation means for separating oil discharged accompanied by said compressed gas from said compressed gas;

an oil separation recovering portion housing said first oil separation means to recover the separated oil;

an oil flow passage for leading the oil recovered by said oil separation recovering portion to an oiling portion within said compressor body through an oil cooler;

an inspecting flow passage branched at a branched point from said discharge flow passage on the downstream side of said oil separation recovering portion and in communication with a portion of the compressor which is lower in pressure than the pressure at said branched point;

a second oil separation means capable of separating oil particles from the compressed gas flowing through said inspecting flow passage; and an oil separation detector for detecting that oil separated by said second oil separation means drops from said second oil separation means, said oil separation detector comprising an oil detection means for electrically detecting a state change caused by contact with the oil dropped from said second oil separation means, and a calculating portion for receiving an electric signal from said oil detection means to calculate the percentage content of oil of said compressed gas from said electric signal.

2. The oil-cooled type compressor according to claim 1, wherein said inspecting flow passage is in communication with a suction flow passage which is a flow passage of gas flowing into said compressor body.

3. The oil-cooled type compressor according to claim 1, wherein said inspecting flow passage is joined with a discharge flow passage on the downstream side away from said branched point, and a throttle means is interposed between said branched point and said joined point.

4. The oil-cooled type compressor according to claim 1, wherein said second oil separation means has the shape of a lower part thereof constituted so that the separated oil drops on a fixed position.

5. The oil-cooled type compressor according to claim 4, wherein said second oil separation means has the shape of a lower end thereof to be spherical.

6. The oil-cooled type compressor according to claim 5, wherein in said second oil separation means, said spherical portion has a slit.

7. The oil-cooled type compressor according to claim 4, wherein in said second oil separation means, oil drops on a plurality of positions.

8. The oil-cooled type compressor according to claim 1, wherein said oil detection means comprises:

a heat conductor, said heat conductor being installed at a position where the oil separated by said second oil separation means drops;

a temperature detector for detecting a temperature of said heat conductor; and a heater for heating said heat conductor, said heater being controlled so that in the state that the oil separated by said second separation means is not dropped, the temperature of said heat conductor is maintained approximately constant.

9. The oil-cooled type compressor according to claim 8, wherein said heat conductor has its lower part to have an elongated shape so as to lead oil downward from the heater or the portion connected with the temperature detector.

10. The oil-cooled type compressor according to claim 8, wherein an oil-proof agent is coated on the heat conductor.

11. The oil-cooled type compressor according to claim 1, wherein said oil detection means comprises a load cell, said load cell detecting the shock force when the oil dropped from said second oil separation means impinges upon said oil detection means.

12. The oil-cooled type compressor according to claim 1, wherein said oil detection means comprises:

a thin plate supported in a cantilever fashion, said thin plate being installed so that oil separated by said second oil separation means drops on the free end thereof, and a strain gage, said strain gage detecting vibrations of said thin plate.

13. The oil-cooled type compressor according to claim 1, wherein said calculating portion obtains the oil content from the interval in which the electric signal changes.

14. The oil-cooled type compressor according to claim 8, wherein said calculating portion obtains the oil content from the temperature dropping amount per unit time.

15. The oil-cooled type compressor according to claim 1, further comprising a siphon, said siphon storing oil dropped from said second oil separation means and flows out the stored oil so as to come in contact with said oil detection means.

16. The oil-cooled type compressor according to claim 1, further comprising:

an oil absorbing member, said oil absorbing member being provided downward of said second oil separation means to absorb oil separated by said second oil separation means, and an electric resistance detection means for detecting the electric resistance of said oil absorbing member.

17. The oil-cooled type compressor according to claim 1, further comprising a flow rate detection means provided on said inspecting flow passage, said flow rate detection means detecting the flow rate of said compressed gas flowing through said inspecting flow passage, and said calculating portion calculates the percentage content of oil of said compressed gas using the flow rate detected by said flow rate detection means.

18. The oil-cooled type compressor according to claim 17, further comprising a flow rate control means provided on said inspecting flow passage, said flow rate control means controlling the flow rate of the compressed gas flowing through said inspecting flow passage in response to an electric signal from said oil detection means.

* * * * *